US007823228B2

(12) United States Patent
Todokoro

(10) Patent No.: US 7,823,228 B2
(45) Date of Patent: Nov. 2, 2010

(54) AUXILIARY TOILET STOOL SEAT

(75) Inventor: Shinji Todokoro, Tokyo (JP)

(73) Assignee: Agatsuma Co., Ltd., Tokyo (JP)

( * ) Notice: Subject to any disclaimer, the term of this patent is extended or adjusted under 35 U.S.C. 154(b) by 731 days.

(21) Appl. No.: 11/764,191

(22) Filed: Jun. 16, 2007

(65) Prior Publication Data

US 2007/0294811 A1 Dec. 27, 2007

(30) Foreign Application Priority Data

Jun. 23, 2006 (JP) ..... 2006-004988 U

(51) Int. Cl.
*A47K 13/00* (2006.01)

(52) U.S. Cl. ..... 4/239; 4/254

(58) Field of Classification Search ..... 4/239, 4/483, 237, 234, 902, 235, 444, 447
See application file for complete search history.

(56) References Cited

U.S. PATENT DOCUMENTS 2,568,322 A * 9/1951 Cunningham ..... 4/239
3,364,505 A * 1/1968 Palmier ..... 4/239
3,431,004 A * 3/1969 Schell ..... 292/258
3,671,981 A * 6/1972 Smith ..... 4/245.7
6,175,968 B1 * 1/2001 Schneider ..... 4/239
6,192,527 B1 * 2/2001 Paul ..... 4/420.4
6,634,037 B2 * 10/2003 Turbett et al. ..... 4/605
6,698,036 B2 * 3/2004 Armbruster et al. ..... 4/483

FOREIGN PATENT DOCUMENTS

JP H6-66495 9/1994

* cited by examiner

*Primary Examiner*—Gregory L Huson
*Assistant Examiner*—Janie Christiansen
(74) *Attorney, Agent, or Firm*—The Marbury Law Group PLLC

(57) ABSTRACT

An auxiliary toilet stool seat adapted to be mounted on a seat of a western-style toilet stool, the auxiliary toilet stool seat having a main body portion which is formed from a hard resin into an annular shape having an angled cross section made open at a bottom and having a flat top portion, a first leg portion which is brought into abutment with a top surface of the auxiliary toilet stool seat, a second leg portion which is slidably movable in such a manner as to follow an inner perimeter of the seat, and a third leg portion which is formed into an L-shape and is brought into abutment with a rear surface of the seat on a horizontal surface of the L-shape, the first, second and third legs being provided on a rear surface of the main body portion of the main body portion.

7 Claims, 10 Drawing Sheets

(B)

(A)

AUXILIARY TOILET STOOL SEAT

BACKGROUND OF THE INVENTION

1. Technical Field

The present invention relates to an auxiliary toilet stool seat for infants.

2. Background Art

Conventionally, there have been known simplified bedpan-like defecation/urination stools for infants which can be carried from room to room. These bedpan-like defecation/urination stools are intended to be used to make infants practice the use of a toilet stool so as to make them give up the use of diapers as early as possible or for use by infants who cannot use an adult toilet stool yet.

On the other hands, while making infants use the simplified bedpan-like defecation/urination stools, parents train them to gradually get used to an adult toilet stool as they grow.

When an infant uses an adult toilet stool which is regarded as a western-style toilet tool, there may occur a case where since a seat is too big for him or her, the infant cannot be seated properly on the seat. As this occurs, an infant auxiliary toilet stool seat, which is small, is mounted on the seat of the adult toilet stool so that the infant can use it properly via the auxiliary toilet stool seat so mounted.

In this way, at certain growing stages of an infant, the simplified infant bedpan-like defecation/urination stool and the infant auxiliary toilet stool seat that is mounted on the western-style adult toilet stool so as to allow the infant to use the adult toilet stool properly have had to be used.

For example, the Japanese Unexamined Utility Model Publication No. 6-66495 discloses an auxiliary toilet stool seat which is an "infant toilet stool" and a simplified infant toilet stool which is a combination of the auxiliary toilet stool seat and a toilet stool bowl. Specifically, in the toilet stool seat disclosed in the invention, since a handle portion, which is attached to the toilet stool so as to be gripped by an infant, constitutes an obstacle when he or she attempts to be mounted on and dismounted from the seat, the handle portion is detachably attached to the seat.

In addition, in recent years, since there are provided western-style toilet stools of various shapes (U-like and O-like shapes), with the conventional auxiliary toilet stool seats, when the auxiliary toilet stool seat is mounted on the western-style toilet stool, there may occur a case where the immobile fixation of the auxiliary toilet stool seat cannot be ensured, and when the auxiliary toilet stool seat is used while the immobile fixation thereof is not ensured, there have been rare cases where fine scratches are caused on the seat of the western-style toilet stool.

SUMMARY OF THE INVENTION

Then, the invention has been made in view of the problems inherent in the related art, and an object thereof is to provide an auxiliary toilet stool seat for infants in which an auxiliary toilet stool seat can be fixed to a seat or bowl of a toilet stool in an ensured fashion and the seat and bowl of the toilet stool can be made free from fine scratches when the auxiliary toilet stool seat is used with them.

According to a first aspect of the invention, there is provided an auxiliary toilet stool seat which can be mounted on a seat of a western-style toilet stool, the auxiliary toilet stool seat having a main body portion which is formed from a hard resin into an annular shape having an angled cross section made open at a bottom and having a flat top portion, including a circumferential edge packing made from a soft resin and adapted to cover a lower end of an outer circumferential edge of the auxiliary toilet stool seat, and further including a first leg portion which is brought into abutment with a top surface of the auxiliary toilet stool seat, a second leg portion which is slidably movable in such a manner as to follow an inner perimeter of the seat and is brought into abutment with the inner perimeter and a third leg portion which is formed into an L-shape and is brought into abutment with a rear surface of the seat on a horizontal surface of the L-shape, the first, second and third legs being provided on a rear surface of the main body portion of the auxiliary toilet stool seat.

According to the first aspect of the invention, the auxiliary toilet stool seat is provided which can be mounted on a seat of a western-style toilet stool, the auxiliary toilet stool seat having the main body portion which is formed from a hard resin into the annular shape having the angled cross section made open at the bottom and having the flat top portion, including the circumferential edge packing made from a soft resin and adapted to cover the lower end of the outer circumferential edge of the auxiliary toilet stool seat, and further including the first leg portion which is brought into abutment with the top surface of the auxiliary toilet stool seat, the second leg portion which is slidably movable in such a manner as to follow the inner perimeter of the seat and is brought into abutment with the inner perimeter and the third leg portion which is formed into the L-shape and is brought into abutment with the rear surface of the seat on the horizontal surface of the L-shape, the first, second and third legs being provided on the rear surface of the main body portion of the auxiliary toilet stool seat, whereby an auxiliary toilet seat for infants can be provided which can allow the auxiliary toilet seat to be fixed properly to a toilet stool seat or bowl and prevent the toilet stool seat or bowl from being given minute scratches or the like when the auxiliary toilet stool seat is used thereon.

According to a second aspect of the invention, there is provided an auxiliary toilet stool seat as set forth in the first aspect of the invention, wherein the first leg portion, the second leg portion, and the third leg portion each have a resin member for protecting the seat of the western-style toilet stool.

According to the second aspect of the invention, the first leg portion, the second leg portion, and the third leg portion each have the resin member for protecting the seat of the western-style toilet stool, whereby the toilet stool seat or bowl can be prevented from being given minute scratches or the like when the auxiliary toilet stool seat is used thereon.

According to a third aspect of the invention, there is provided an auxiliary toilet stool seat as set forth in the first aspect of the invention, wherein the third leg portion is rotatable and includes a spring so as to enable a proper press contact with the seat according to the thickness thereof.

According to the third aspect of the invention, the third leg portion is rotatable and includes the spring so as to enable a proper press contact with the seat according to the thickness thereof, whereby the auxiliary toilet stool seat can be fixed to a seat of a toilet stool which is formed into an O-shape or U-shape in an ensured fashion.

According to a fourth aspect of the invention, there is provided an auxiliary toilet stool seat as set forth in the first aspect of the invention, wherein the auxiliary toilet stool seat includes a rotatable hook by which the auxiliary toilet stool seat can be suspended.

According to the fourth aspect of the invention, the auxiliary toilet stool seat includes the rotatable hook by which the auxiliary toilet stool seat can be suspended, whereby the auxiliary toilet stool seat can be stored by being suspended on a wall.

According to a fifth aspect of the invention, there is provided an auxiliary toilet stool seat as set forth in the first aspect of the invention, wherein an opening for a hot-water washing unit is provided on an inner edge of the auxiliary toilet stool seat.

According to the fifth aspect of the invention, the opening for a hot-water washing unit is provided on the inner edge of the auxiliary toilet stool seat, whereby the operation of the hot-water washing unit cannot be disturbed.

According to a sixth aspect of the invention, there is provided an auxiliary toilet stool seat as set forth in the first aspect of the invention, wherein the auxiliary toilet stool seat includes a handle portion that is to be gripped by an infant when the infant uses the auxiliary toilet stool seat and has a handle portion mounting recess portion where the handle portion is mounted at a distal end portion of the auxiliary toilet stool seat, so that the handle portion is mounted and dismounted freely in either a forward direction or a backward direction.

According to the sixth aspect of the invention, the auxiliary toilet stool seat includes the handle portion that is to be gripped by an infant when the infant uses the auxiliary toilet stool seat and has the handle portion mounting recess portion where the handle portion is mounted at the distal end portion of the auxiliary toilet stool seat in either the forward direction or backward direction, whereby the infant can use the toilet stool via the auxiliary toilet stool seat with a stable posture.

According to a seventh aspect of the invention, there is provided an auxiliary toilet stool seat as set forth in the sixth aspect of the invention, wherein the handle portion mounting recess portion is formed into an oval-like shape and includes cut-out portions provided in positions on a circumferential edge thereof which diametrically face each other and an opening in a bottom side thereof, while the handle portion includes a fitting portion adapted to be fitted in the opening on a lower side thereof and has engagement claw portions on a circumferential edge of the lower side thereof in such a manner as to appear and disappear for engagement with and disengagement from the cut-out portions, the engagement claw portions being made to appear and disappear in association with engagement and disengagement of the fitting portion in and from the opening.

According to the seventh aspect of the invention, the handle portion mounting recess portion is formed into the oval-like shape and includes the cut-out portions provided in positions on the circumferential edge thereof which diametrically face each other and then opening in the bottom side thereof, while the handle portion includes the fitting portion adapted to be fitted in the opening on the lower side thereof and has engagement the claw portions on the circumferential edge of the lower side thereof in such a manner as to appear and disappear for engagement with and disengagement from the cut-out portions, the engagement claw portions being made to appear and disappear in association with engagement and disengagement of the fitting portion in and from the opening, whereby the handle portion can be fixed to the auxiliary toilet stool seat in an ensured fashion.

According to an eighth aspect of the invention, there is provided an auxiliary toilet stool seat as set forth in the sixth aspect of the invention, wherein an external appearance of the handle portion is formed into a profile of a desired object, and a voice output unit for outputting voice by a voice IC is provided on a back side of the handle portion.

According to the eighth aspect of the invention, the external appearance of the handle portion is formed into a profile of a desired object, and the voice output unit for outputting voice by the voice IC is provided on the back side of the handle portion, whereby the auxiliary toilet stool seat can be an auxiliary toilet stool seat in which infants are caused to get interested much.

BRIEF DESCRIPTION OF THE DRAWINGS

In addition.

Furthermore.

DESCRIPTION OF THE PREFERRED EMBODIMENT

An auxiliary toilet stool seat which can be mounted on a seat of a western-style toilet stool has a main body portion which is formed from a hard resin into an annular shape having an angled cross section made open at a bottom and having a flat top portion, includes a circumferential edge packing made from a soft resin and adapted to cover a lower end of an outer circumferential edge of the auxiliary toilet stool seat, and further includes a first leg portion which is brought into abutment with a top surface of the auxiliary toilet stool seat, a second leg portion which is slidably movable in such a manner as to follow an inner perimeter of the seat and is brought into abutment with the inner perimeter and a third leg portion which is formed into an L-shape and is brought into abutment with a rear surface of the seat on a horizontal surface of the L-shape, the first, second and third legs being provided on a rear surface of the main body portion of the auxiliary toilet stool seat. In addition, the first leg portion, the second leg portion, and the third leg portion each have a resin member for protecting the seat of the western-style toilet stool, and the third leg portion is rotatable and includes a spring so as to enable a proper press contact with the seat according to the thickness thereof. Moreover, an opening for a hot-water washing unit is provided on an inner edge of the auxiliary toilet stool seat. In addition, the auxiliary toilet stool seat may include a rotatable hook by which the auxiliary toilet stool seat can be suspended. Additionally, the auxiliary toilet stool seat may include a handle portion which is adapted to be gripped by an infant when the infant uses the auxiliary toilet stool seat, formed into the shape of a desired object and mounted detachably at a distal end of the auxiliary toilet stool seat. Furthermore, a voice output unit for outputting voice by a voice IC may be provided in the handle portion.

Figure 1:
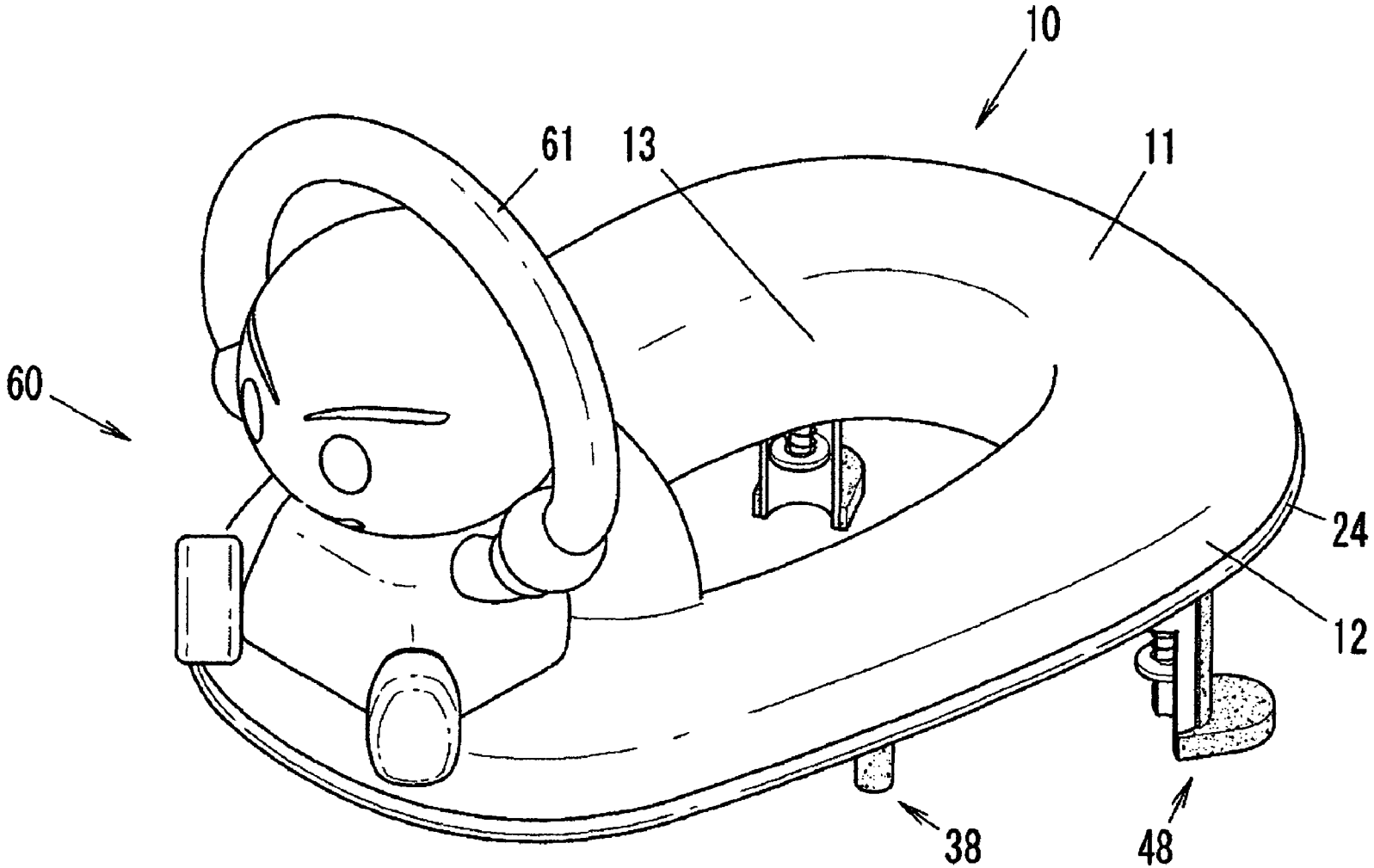
FIG. 1 is a perspective view showing an external appearance of an auxiliary toilet stool seat according to an embodiment of the invention.
Figure 2:
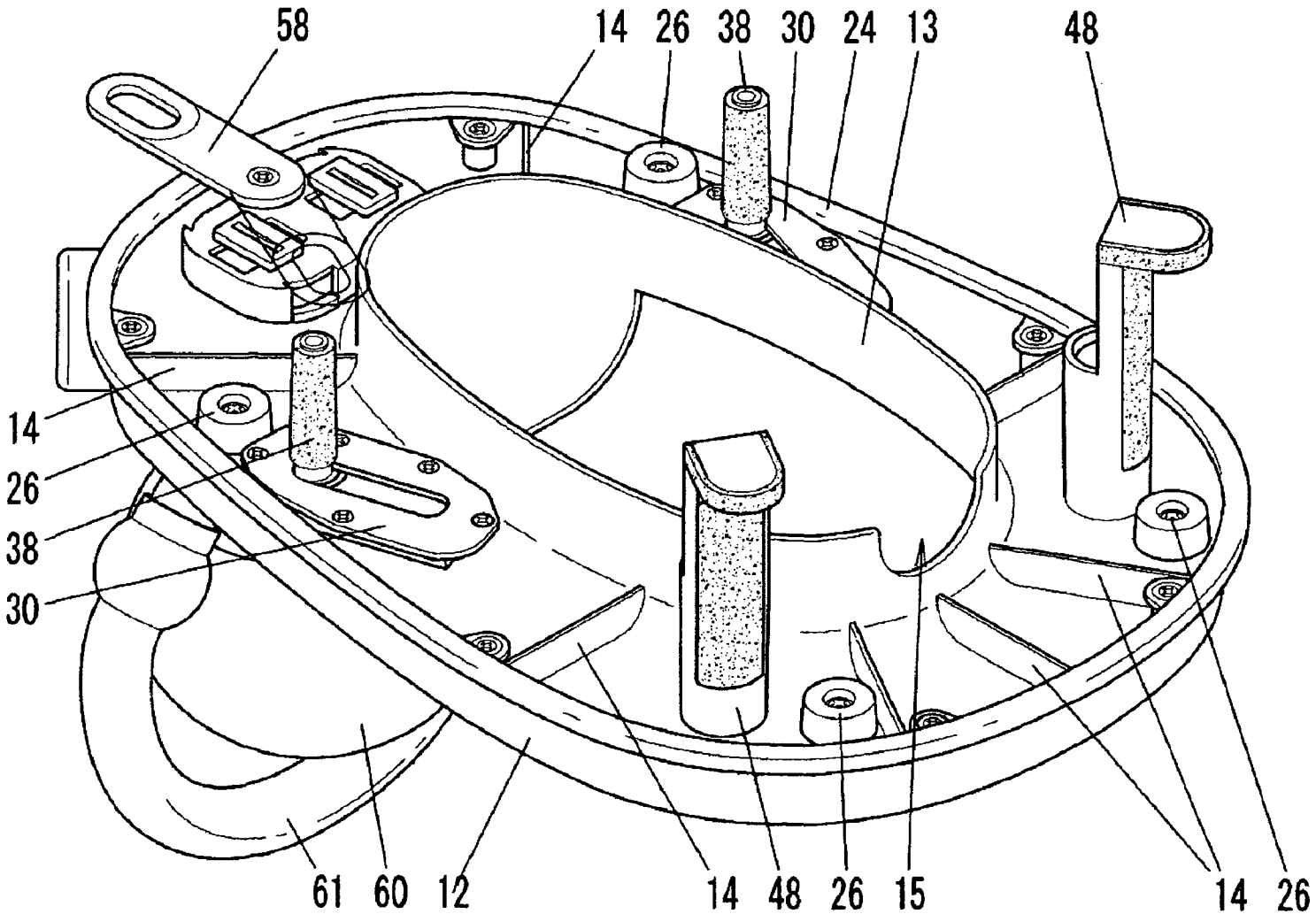
FIG. 2 is a perspective view showing a rear side of the auxiliary toilet stool seat according to the embodiment of the invention.
Figure 8:
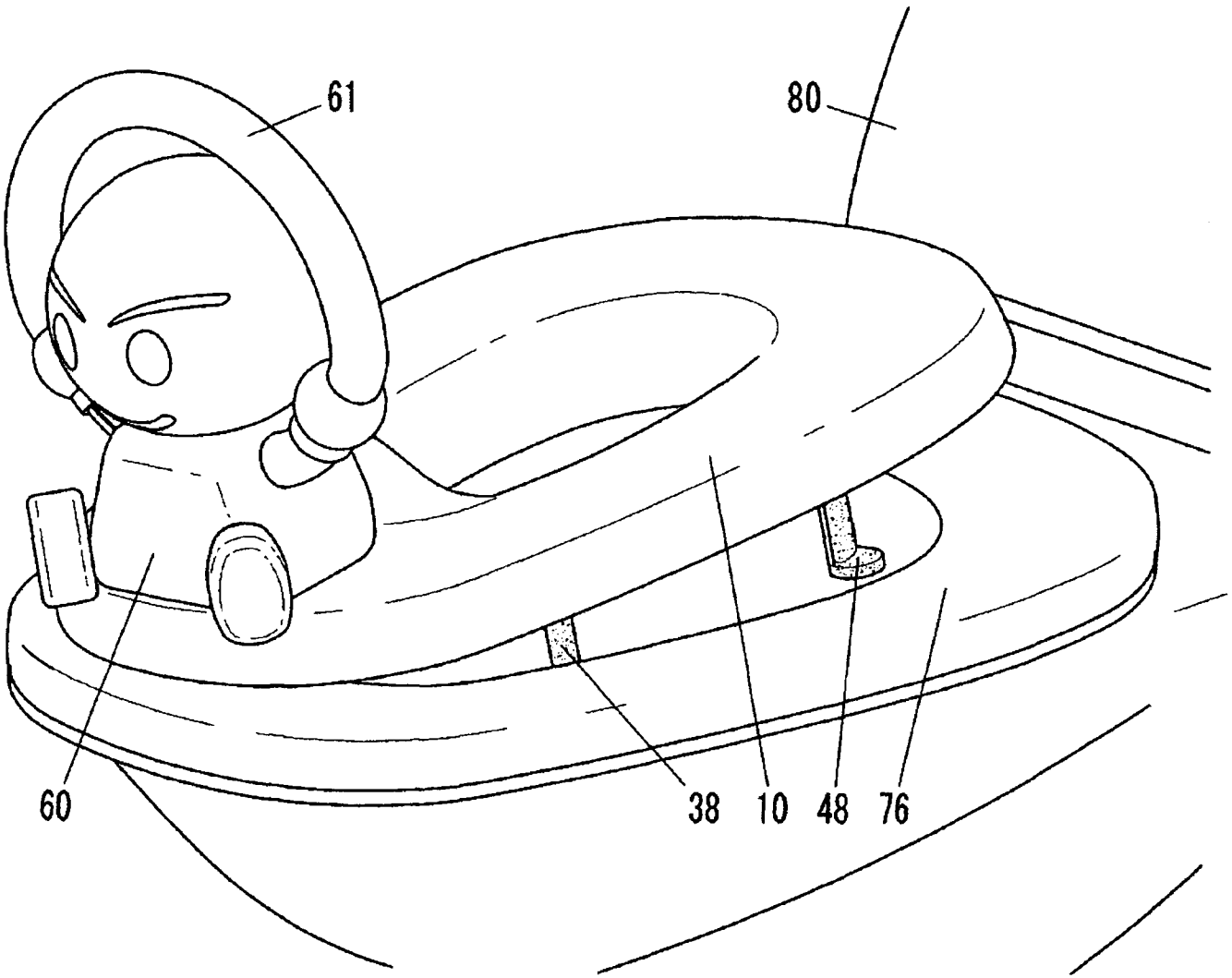
FIG. 8 shows how the auxiliary toilet stool seat according to the embodiment of the invention is placed on and fixed to a seat of a toilet stool.

Hereinafter, an embodiment of an auxiliary toilet stool seat according to the invention will be described in detail by reference to the accompanying drawings. FIG. 1 is a perspective view showing an external appearance of an auxiliary toilet stool seat of the invention. FIG. 2 is a perspective view showing a rear side of the auxiliary toilet stool seat. As is shown in FIG. 8, this auxiliary toilet stool seat is such that an auxiliary toilet stool seat main body portion 10 is placed on and fixed to a seat 76 of a western-style toilet stool 80, so that an infant can use the western-style toilet stool 80.

This auxiliary toilet stool seat is made up of the auxiliary toilet stool seat main body portion 10 and a handle portion 60 which can be attached to and detached from the auxiliary toilet stool seat 10.

Firstly, the auxiliary toilet stool seat main body portion 10 will be described. The auxiliary toilet stool seat main body portion 10 is formed of a hard resin into an annular O-like shape having an angular cross section which is made open at a bottom and having a flat top portion and is made up of an outer edge portion 12 which is suspended long downwards from an outer circumferential edge of an upper surface portion 11 which constitutes the top portion and an inner edge portion 13 which is suspended downwards longer than the outer edge portion 12 from an inner circumferential edge of the upper surface portion 11. In addition, a plurality of ribs 14 are formed on an inside of the upper surface portion 11 of the auxiliary toilet stool seat main body portion 10 in such a manner as to connect the inner circumferential edge portion 13 and the outer circumferential edge portion 12, so as to increase the rigidity of the auxiliary toilet stool seat main body portion 10. Furthermore, the auxiliary toilet stool seat main body portion 10 includes a circumferential edge packing 24 which covers a lower end of the outer circumferential edge portion 12. This circumferential edge packing 24 is formed from a resin material such a thermoplastic elastomer and is intended to prevent the seat 76 from being given minute scratches by an end portion of the outer circumferential edge portion 12 of the auxiliary toilet stool seat main body 10 when the end portion is brought into abutment with the seat 76.

Figure 6:
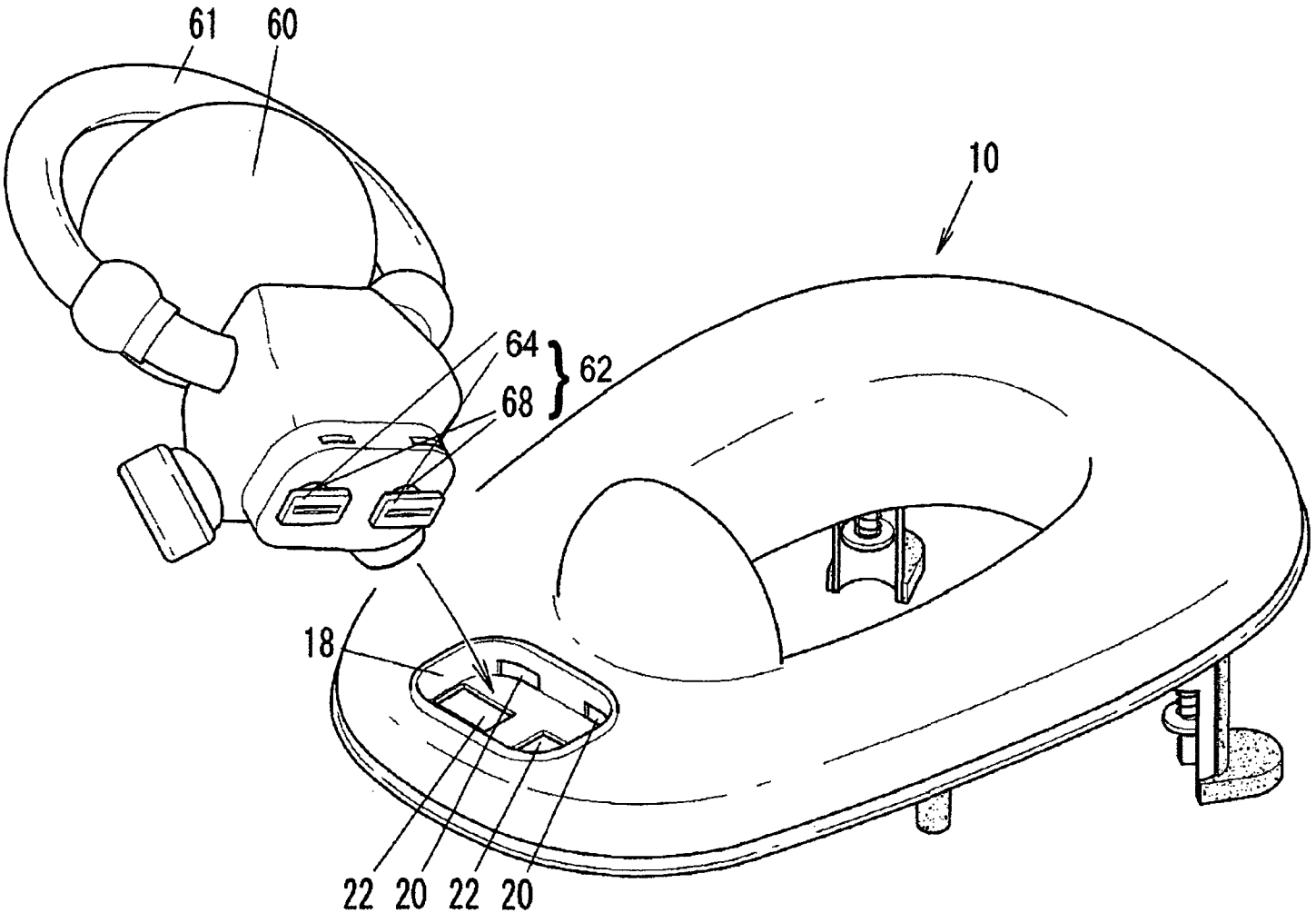
FIG. 6 shows a state where a handle portion is removed from an auxiliary toilet stool seat main body portion of the auxiliary toilet stool seat according to the embodiment of the invention.

In addition, as is shown in FIG. 6, an oval recess portion is formed at the front of the upper surface portion 11 of the auxiliary toilet stool seat main body portion 10 so as to constitute a handle portion mounting recess portion 18, and a cut-out portion 20 constituting a rectangular hole is formed in each of facing positions on a circumferential edge of the handle portion mounting recess portion 18. In addition, a pair of openings 22, which each form a rectangular hole, are formed in a bottom surface of the handle portion mounting recess portion 18. The cut-out portion 20 in the handle portion mounting recess portion 18 are adapted to be brought into engagement with engagement claw portions 72 of the handle portion 60, which will be described later on, and the openings 22 in the handle portion mounting recess portion 18 are adapted to be brought into fitting engagement with fitting portions 62 of the handle portion 60. Consequently, in this auxiliary toilet stool seat, the handle portion 60 can detachably mounted in the handle portion mounting recess portion 18 while oriented towards the front or rear of the main body portion 10.

Additionally, a semicircular opening 15 for a hot-water washing unit is formed in a rear portion of the inner circumferential edge portion 13 of the auxiliary toilet stool seat main body portion 10, so as not to interrupt the operation of the hot-water washing unit even when the auxiliary toilet stool seat is placed on and fixed to a seat 76 of a toilet stool with a hot-water washing unit.

As is shown in FIG. 2, the auxiliary toilet stool seat main body portion 10 has on the inside of the upper surface portion 11 first leg portions 26 which are adapted to be brought into abutment with an upper surface of the seat 76, second leg portions 38 which are adapted to move in a sliding fashion to follow an inner perimeter of the seat 76 and be brought into abutment with the inner perimeter, and third leg portions 48 which are each formed into an L-shape and are each adapted to rotate freely so as to be brought into press contact with a rear side of the seat 76. The second leg portions 38 are each allowed to be adjusted with respect to their positions by a size adjusting portion 30, which will be described later on. The auxiliary toilet stool seat main body portion 10 is designed to make itself be placed on and fixed to the seat 76 in an ensured fashion by the use of these first leg portions 26, second leg portions 38 and third leg portions 48. The first leg portions 26, second leg portions 38 and third leg portions 48 will be described below which are used to ensure that the auxiliary toilet stool seat main body 10 is placed on and fixed to the seat 76.

Figure 3:
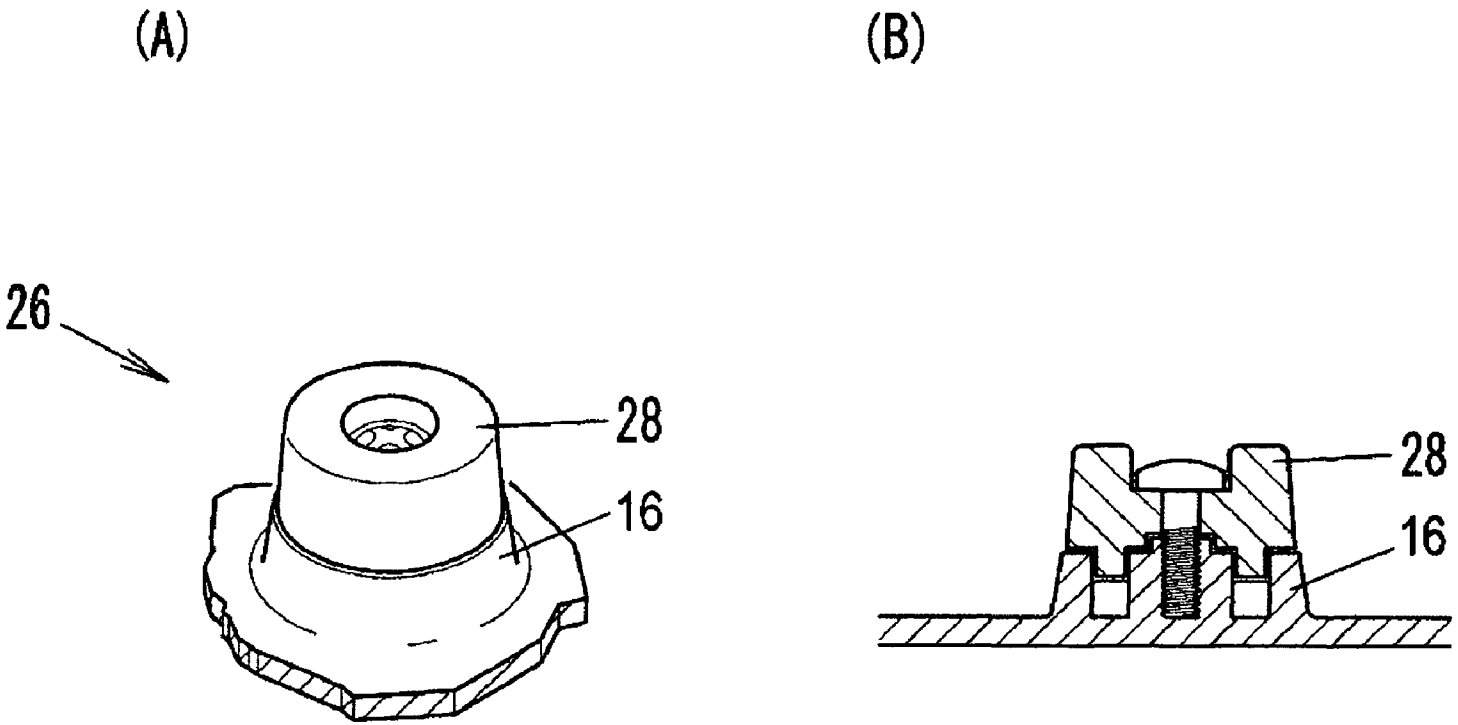
FIG. 3 shows a first leg portion of the auxiliary toilet stool seat according to the embodiment of the invention.

Firstly, the first leg portion 26 will be described. As is shown in FIG. 2, the first leg portion 26 is provided on four locations on the rear surface of the auxiliary toilet stool seat main body portion 10, and as shown in FIG. 3, the first leg portion 26 is made up of a first leg portion mounting portion 16 which is formed from a hard resin substantially into a cylindrical shape and is secured to the inside of the upper surface portion 11 of the auxiliary toilet stool seat main body portion 10 and a first leg portion elastic member 28 which is formed from a resin material such as a thermoplastic elastomer into a cylindrical shape. The first leg portion elastic member 28 is secured to an end face of the first leg portion mounting portion 16 by means of a screw. By securing the first leg portion elastic member 28 to the second leg portion mounting portion 16, the first leg portion 26 slightly protrudes from the outer circumferential edge portion 12 of the auxiliary toilet stool seat main body portion 10 so as to be brought into abutment with the upper surface of the seat 76 when the auxiliary toilet seat main body portion 10 is placed on and fixed to the seat 76, whereby longitudinal and transverse deviations of the auxiliary toilet seat main body portion 10 can be prevented by virtue of frictional force produced between the resin material such as a thermoplastic elastomer and the upper surface of the seat 76.

Figure 4:
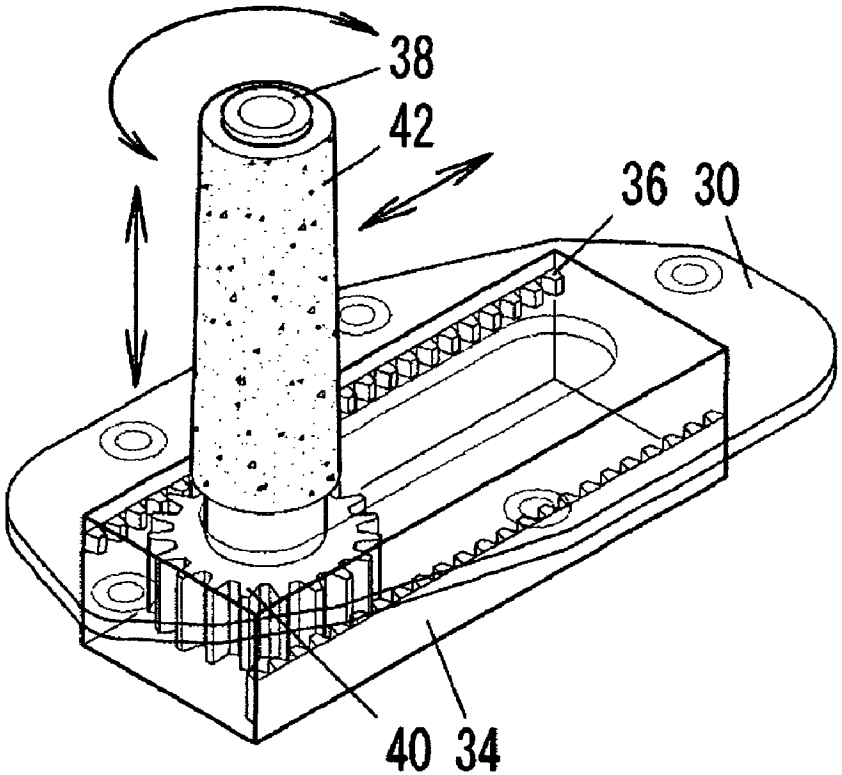
FIG. 4 shows a second leg portion of the auxiliary toilet stool seat according to the embodiment of the invention.
Figure 4:
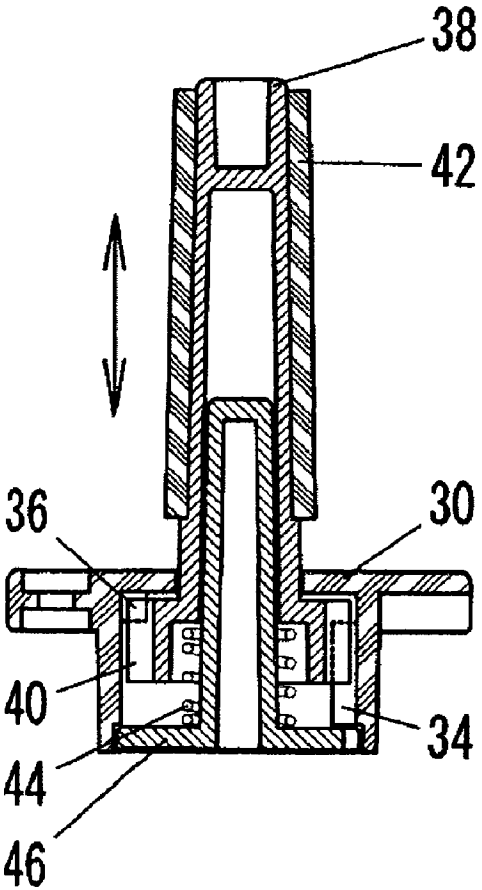

Next, the second leg portion 38 will be described. As is shown in FIG. 2, the second leg portion 38 is provided in two left and right locations in such a manner as to be positioned in the vicinity of the first leg portion 26. As is shown in FIG. 4, this second leg portion 38 is allowed to slide along the inner perimeter of the seat 76 by the size adjusting portion 30, so as to adjust the position thereof. The position of the second leg portion 38 can be adjusted by utilizing the size adjusting portion 30, a sliding member 46 and a spring 44 made up of a compression spring.

The size adjusting portion 30 is formed substantially into a rectangular parallelepiped shape which is made open at a lower side thereof so as to be hollowed, and an elongated hole 32, which is opened in parallel with a longitudinal direction of the size adjusting portion 30, is formed in the center of an upper surface of the size adjusting portion 30. In addition, a first rack 34 having a toothed portion and a second rack 36 having a toothed portion are formed inside the size adjusting portion 30 in such a manner as to face each other, the second rack 36 being formed shorter than the first rack 34 with respect to a length oriented downwards as viewed in FIG. 4.

Next, the second leg portion 38 is formed substantially into a cylindrical shape and has a gear wheel 40 which is formed at a lower end of the cylindrical shape in such a manner as to bulge radially outwards like a collar. The second leg portion 38 is provided in such a manner as to project from the elongated hole 32 in the side adjusting portion 30, and the gear wheel 40 at the lower end of the second leg portion 38 is brought into mesh engagement with the first rack 34 and the second rack 36 of the size adjusting portion 30, respectively. The second leg portion 38 is not allowed to slide and rotate in such a state that the gear wheel 40 of the second leg portion 38 meshes with the first rack 34 and the second rack 36.

In addition, an elastic element 42, which is formed from a resin material such as a thermoplastic elastomer into a cylindrical shape, is secured to the second leg portion 38 as shown in the figures, whereby when the second leg portion 38 is brought into abutment with the inner perimeter of the seat 76, the auxiliary toilet stool seat main body portion 10 can be fixed by virtue of friction produced between the elastic element 42 and the inner perimeter of the seat 76. Furthermore, even when the second leg portion 38 is brought into abutment with the inner perimeter of the seat 76, the elastic element 42 prevents the inner perimeter of the seat 76 from being given minute scratches.

The sliding member 46 is formed into a rod shape, whose outside diameter is made slightly smaller than an inside diameter of the second leg portion 38, and a rectangular thin plate is secured to a lower end of the sliding member 46. The spring 44 is wound round the circumference of the sliding member 46, which is formed into the rod shape, and thereafter, an upper portion of the sliding member 46 is fittingly inserted into the cylinder from below the second leg portion 38. The second leg portion 38 is biased to be pushed upwards, as viewed in the figures, at all times by means of the spring 44.

A method for adjusting the position of the second leg portion 38 will be described below. Firstly, when the second leg portion 38 is pushed downwards, the meshing state between the gear wheel 40 of the second leg portion 38 and the second rack 36, which is shorter than the first rack 34 with respect to the downward length, is released. Because of this, while the gear wheel 40 of the second leg portion 38 is kept meshing with the first rack 34, the second leg portion 38 is allowed to rotate, whereby by being rotated, the second leg portion 38 is allowed to slide along the elongated hole formed in the center of the upper surface of the size adjusting portion 30. In addition, after the second leg portion 38 is caused to slide to adjust its position, when the second leg portion 38 is released from the downwardly pushed state, the second leg portion 38 is biased upwards by virtue of the biasing force of the spring 44. Because of this, the gear wheel 40 of the second leg portion 38 is brought into meshing engagement with the second rack 36 again. Consequently, the second leg portion 38 is brought into meshing engagement with the first rack 34 and the second rack 36 again to thereby be put again in the state where the second leg portion 38 is not allowed to slide and rotate, whereby the second leg portion 38 is fixed in place. In this way, for example, by adjusting the second leg portion 38 until it is located in a position where the second leg portion 38 is brought into the inner perimeter of the seat 76 after the auxiliary toilet stool seat main body portion 10 is placed on the seat 76, the auxiliary toilet stool seat main body portion 10 can be fixed to various types of seats 76 which differ in size.

Figure 5:
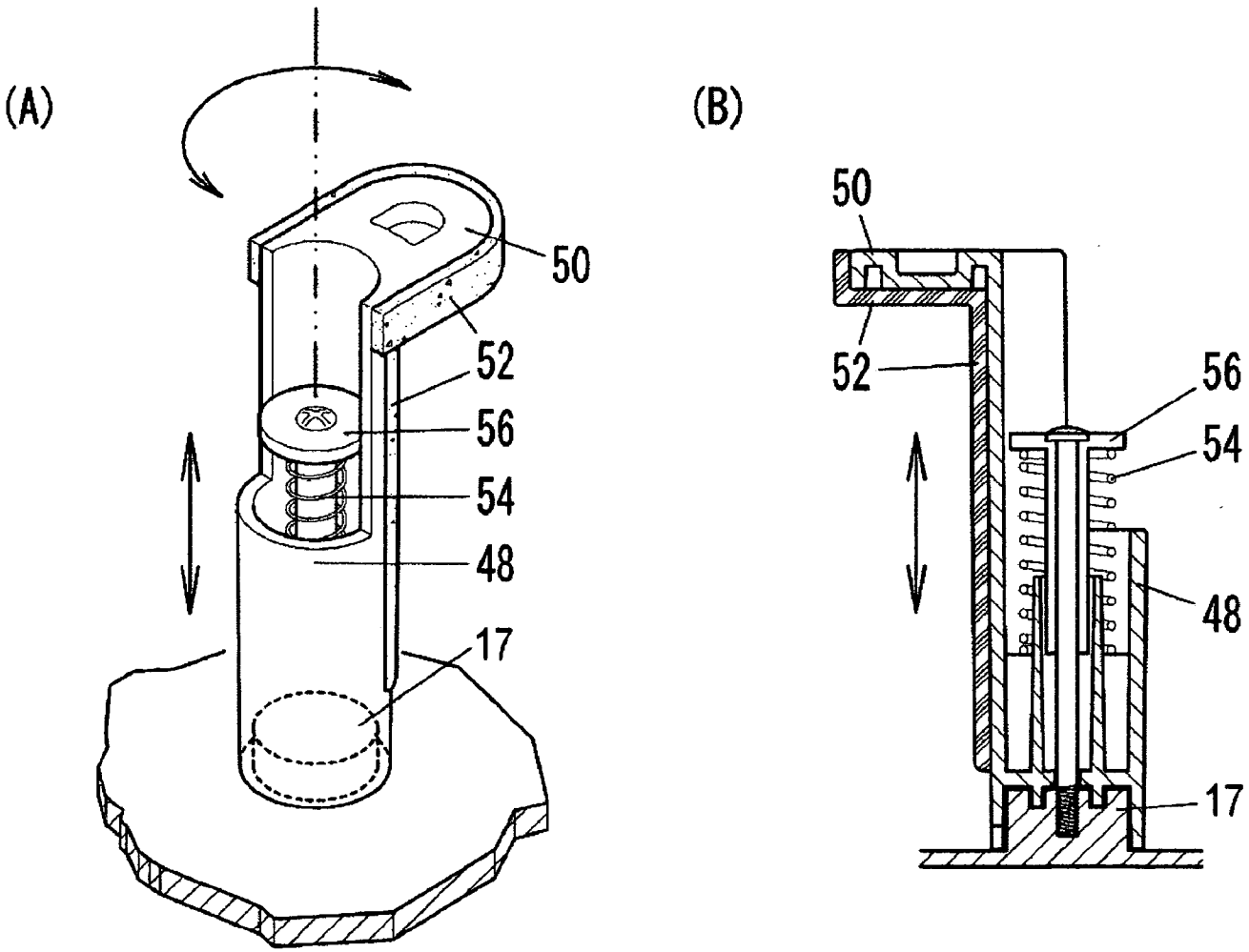
FIG. 5 shows a third leg of the auxiliary toilet stool seat according to the embodiment of the invention.

Next, the third leg portion 48 will be described. As is shown in FIG. 2, this third leg portion 48 is provided in two left and right locations in such a manner as to be positioned in the vicinity of the first leg portion 26, and as shown in FIG. 5, the third leg portion 48 is mounted on a third leg portion mounting portion 17 by utilizing a spring 54 and a spring retaining member 56 in such a manner as to freely rotate, as well as extend and contract. The third leg portion 48 is formed into an L-shape, and when the auxiliary toilet stool seat main body 10 is placed on and fixed to the seat 76, the third leg portion 48 can be rotated according to the shape of the seat 76, and the third leg portion 48 can be extended or contracted according to the thickness of the seat 76, whereby the auxiliary toilet stool seat main body portion 10 is fixed in place relative to the seat 76 by bringing the rear surface of the seat 76 and the third leg portion 48 into press contact with each other.

The third leg portion mounting portion 17 is such as to be secured to the inside of the upper surface portion 11 of the auxiliary toilet stool seat main body portion 10, and this third leg portion mounting portion 17 is formed of a hard resin substantially into a cylindrical shape.

In addition, the third leg portion 48 is made up of an inner tube and an outer tube to thereby be formed into a double-tube configuration. The inner tube is formed to a length which extends from the vicinity of a lower end to the vicinity of a center of the outer tube, and the outer tube is formed to be diametrically slightly smaller than a diameter of the third leg portion mounting portion 17, and a half of the outer tube from the vicinity of the center to an upper end thereof is cut away. A hook portion 50 is formed at the upper end of the outer tube in such a manner as to bulge substantially into a D-shape in a symmetrical direction with the direction in which the outer tube is cut away, whereby the third leg portion 48 is formed into the L-shape with the hook portion 50 made to constitute a horizontal portion of the L-shape. A lower end of the third leg portion 48 is fitted on the third leg portion mounting portion 17 which is formed substantially into the cylindrical shape in such a manner as to cover the relevant portion while allowed to freely rotate, as well as extend and contract.

In addition, a plate-like elastic element 52, which is formed from a resin material such as a thermoplastic elastomer, is secured to an internal surface of the third leg portion 48 in such a manner as to prevent the third leg portion 48 and the rear surface and inner perimeter of the seat 76 from being given minute scratches, as well as secure a sufficient horizontal length for the hook portion 50.

Next, the spring retaining member 56 is formed into a cylindrical shape which has a diameter slightly smaller than an inside diameter of the inner tube of the third led portion 48 and has a disc-like collar portion formed at an upper end thereof. Then, the spring 54, which is made up of a cylindrically wound compression spring, is wound round the periphery of the cylindrical shape of the spring retaining member 56. The spring retaining member 56 is fitting inserted into the inner tube of the third leg portion 48 and is thread fastened by a screw. The spring 54, which is wound round the periphery of the cylindrical shape of the spring retaining member 56, biases the third leg portion 48 downwards at all times, whereby the third leg portion 48 is allowed to freely extend and contract in vertical directions within a lengthwise range from the upper end of the inner tube of the third leg portion 48 to the disc-like collar portion of the spring retaining member 56.

Next, using FIGS. 1 and 6, the handle portion 60 will be described. The handle portion 60 is formed into a shape which takes the shape of a desired object such as a character, animal or the like, and a grip portion 61 is provided at an upper portion of the handle portion 60. When using the auxiliary toilet stool seat, an infant is allowed to grip on the grip portion so that he or she can use the auxiliary toilet stool seat main body portion 10 with a stable posture.

A pair of fitting portions 62 are attached to a lower surface of the handle portion 60 in such a manner as to rotate freely. Each of the fitting portions 62 is formed into a such a shape that a rectangular thin plate is secured to either end of each of a pair of shafts 68, and an engagement plate 64, which constitutes one of the thin plates of each fitting portion 62, is provided in such a manner as to protrude outwards of the handle portion 60. The respective engagement plates 64 of the fitting portions 62, which are provided to protrude outwards of the handle portion 60, are fittingly inserted into the pair of openings 22 formed in the bottom surface of the handle portion mounting recess portion 18, respectively, and when rotated through 90 degrees, the respective engagement plates 64 are brought into engagement with the respective openings 22. In addition, when rotated further through 90 degrees from that state, the engagement between the respective engagement plates 64 of the fitting portions 62 and the respective openings 22 is released.

Figure 7:
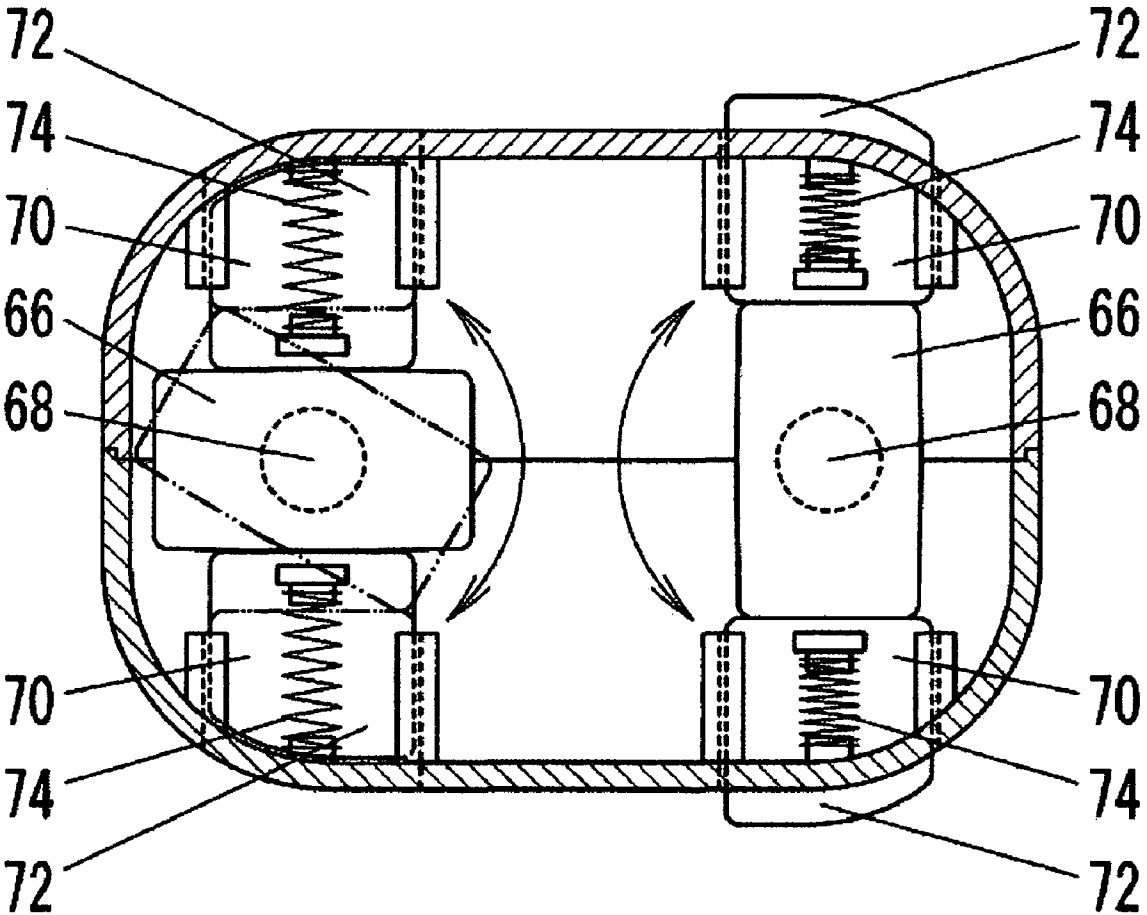
FIG. 7 shows an interior of the handle portion of the auxiliary toilet stool seat according to the embodiment of the invention.

In the vicinity of an operating plate 66, which constitutes the other thin plate which is provided in an interior of the handle portion 60 (refer to FIG. 7), moving pieces 70, each having an engagement claw portion 72 at a distal end thereof, are provided slidably. The engagement claw portion 72 is allowed to appear and disappear in association with sliding motions of each sliding piece 70, and this sliding piece 70 is biased at all times by the action of a spring 74 in the direction of the operating plate 66 which is a direction in which the engagement claw portion 72 is retracted inwards. When the respective engagement plates 64 are rotated through 90 degrees, the corresponding operating plates 66 are similarly rotated through 90 degrees, and the respective moving pieces 70 are pushed outwards by the operating plates 66 which are formed into the rectangular shape, whereby the respective engagement claw portions 72 slide to protrude outwards. In addition, when the respective engagement plates 64 of the fitting portions 62 are rotated further 90 degrees from this state, the pressures applied to the moving pieces 70 by the corresponding operating plates 66 are released, whereby the moving pieces 70 slid in the direction of the operating plates 66 by virtue of the biasing forces of the springs 74, so that the engagement claw portions 72 are retracted inwards. By bringing the engagement claw portions 72 into the protruding state, the engagement claw portions 72 are allowed to be fitted in the mating cut-out portions 20 formed in the handle portion mounting recess portion 18. By adopting this configuration, the handle portion 60 can be fixed to the handle portion mounting recess portion 18 formed in the auxiliary toilet stool seat main body portion 10 in an ensured fashion.

In addition, a voice IC chip, not shown, and a voice output unit are provided inside the handle portion 60. Voice information is output by the voice IC chip installed in the interior of the handle portion 60, and voice or speech is outputted from the voice output unit according to the voice information so outputted. In addition, voice buttons A, B and C, not shown, are provided on a back side of the handle portion 60, so that when the voice buttons are pushed down, different pieces of voice information are outputted from the voice IC chip. For example, when the voice button A is pushed down, the voice IC chip outputs voice information such as "Well done," "Can you do it?" or "Good boy (of Good girl)." When the voice button Bis pushed down, voice information regarding music is outputted, and when the voice button C is pushed down, for example, an effect of flowing sound of water is outputted as voice information.

In this way, by forming the handle portion 60 into the shape which resembles the shape of a desired object such as a character or animal of which infants are fond or designing the handle portion 60 to output voice, speech or sound of which infants are fond, so as to make infants feel happy to play with the auxiliary toilet stool seat, whereby they can be made to be seated on the auxiliary toilet stool seat. Making infants use the auxiliary toilet stool seat while they are seated thereon helps train them to give up the use of diapers as early as possible.

Figure 9:
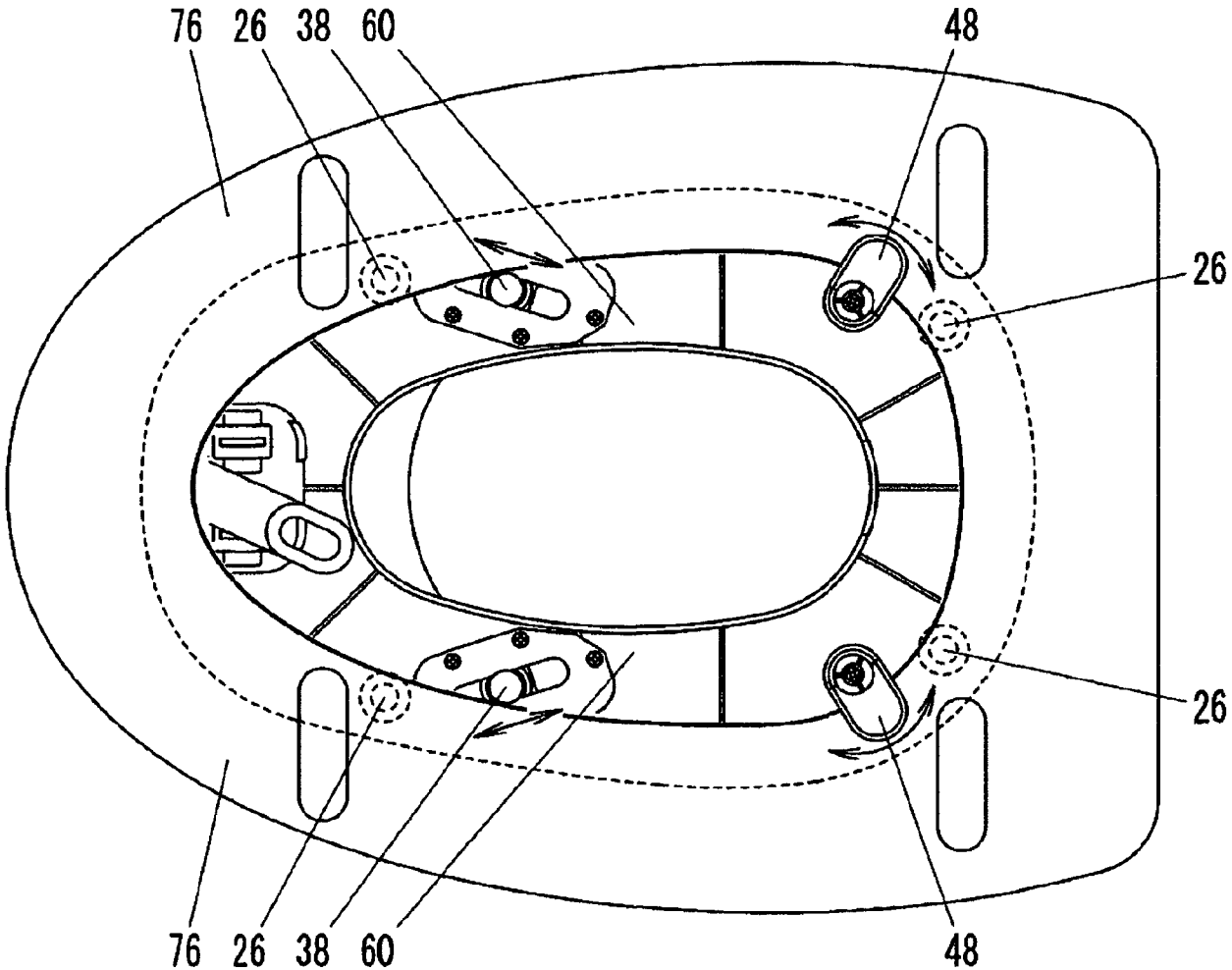
FIG. 9 shows a rear side of the auxiliary toilet stool seat according to the embodiment of the invention which is now placed on and fixed to the seat of the toilet stool.

Referring to FIGS. 8 and 9, an example will be described in which the auxiliary toilet stool seat main body portion 10 is placed on and fixed to the seat 76 of the western-style toilet stool 80 for adults. Firstly, the auxiliary toilet stool seal main body portion 10 is placed in the center of the seat 76 on which the main body portion 10 is to be placed for fixation. Thereafter, the seat 76 is lifted, of the second leg portions 38 and the fourth leg portions 48 which are provided at the four locations along the inside of the upper surface portion 11 of the auxiliary toilet stool seat main body portion 10, the third leg portions 48 are rotated or extended or contracted so that the hook portions 50, which each constitute the horizontal plane of the L-shape of the third leg portion 48, are brought into press contact with the rear surface of the seat 76. Thereafter, the positions of the second leg portions 38 are adjusted such that the second leg portions 38 slide to positions where they are brought into abutment with the inner perimeter of the seat 76. In addition, the first leg portions 26, which are provided in the four locations on the inside of the upper surface portion 11 of the auxiliary toilet stool seat main body portion 10, are brought into abutment with the upper surface of the seat 76, whereby the auxiliary toilet stool seat main body portion 10 is prevented from moving longitudinally or transversely by virtue of the frictional force produced between the upper surface of the seat 76 and the first leg portions 26. In this way, by the actions of the first leg portions 26, the second leg portions 38 and the third leg portions 48, the auxiliary toilet stool seat main body portion 10 can be placed on and fixed to various types of toilet stool seats 76 which differ in size and shape.

Then, since the hook portion 50 of the third leg portion 48 is made long, even with a toilet stool seat 76 which has a curved internal section, a distal end of the hook portion 50 can be brought into abutment with a rear side of the seat 76, whereby the hook portion 50 is brought into press contact with the seat by means of the spring 54, so as to prevent the floating of the auxiliary toilet stool seat main body portion 10.

Figure 10:
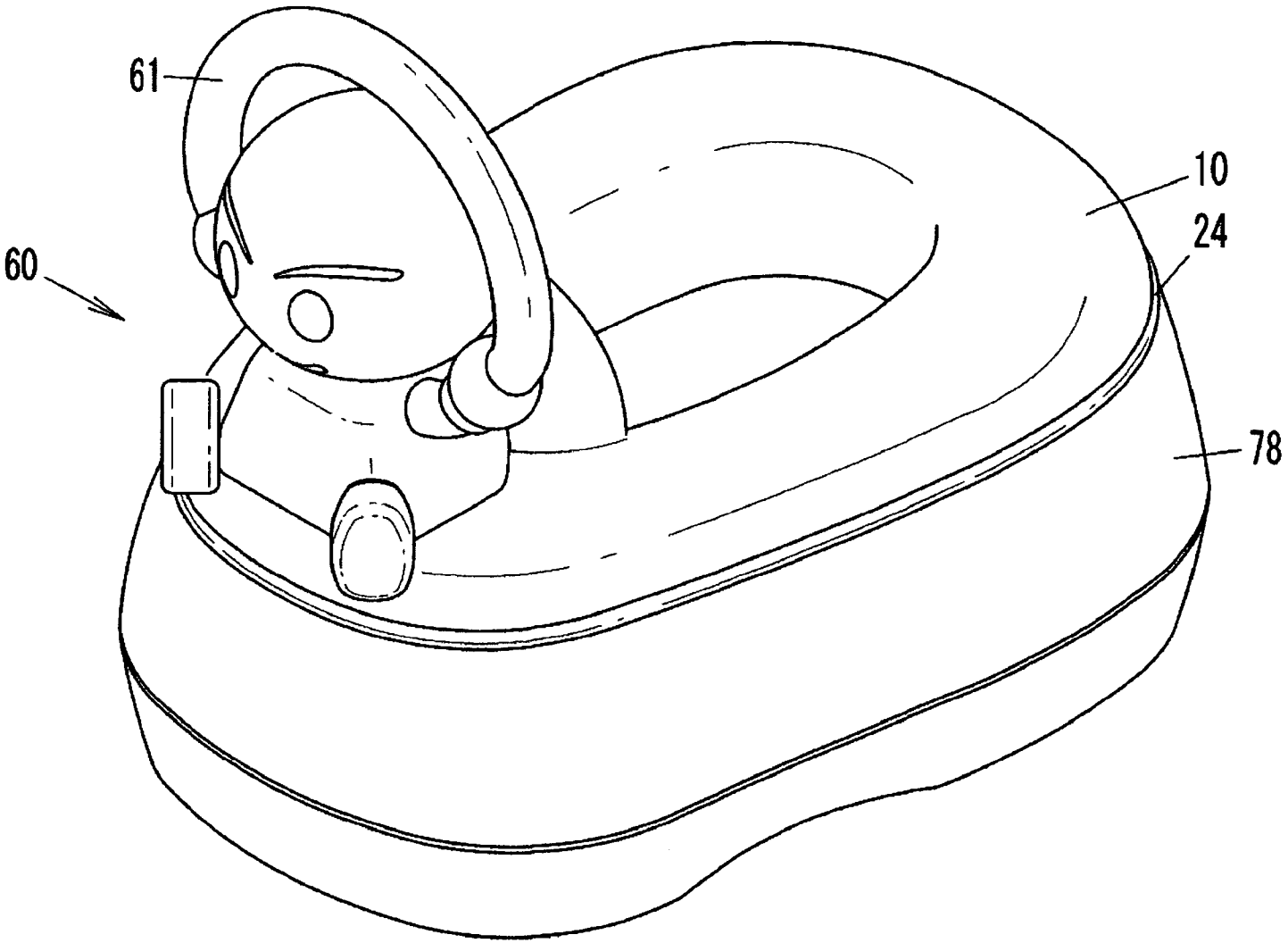
FIG. 10 shows a state where the auxiliary toilet stool seat according to the embodiment of the invention is placed on and fixed to a simplified, handy infant toilet stool.

In addition, FIG. 10 shows a state where the auxiliary toilet stool seat main body portion 10 is mounted on a carrying toilet stool bowl 78. By mounting the auxiliary toilet stool seat main body portion 10 on the carrying toilet stool bowl 78 in this way, the relevant bowl can be used as a simplified, handy infant toilet stool bowl.

Although not shown, it is possible to cover the whole of the auxiliary toilet stool seat main body portion 10 with an auxiliary toilet stool seat cover made of cloth, whereby the auxiliary toilet stool seat main body portion 10 is prevented from getting dirty directly. In the event that the cover gets dirty, by washing the auxiliary toilet stool seat cover, the auxiliary toilet stool seat main body portion 10 can be kept clean at all times. In addition, even in the event that the auxiliary toilet stool seat main body portion 10 gets dirty, the whole of the auxiliary toilet stool seat main body portion 10 can be washed with water, thereby making it possible to keep the main body portion clean at all times.

In addition, when the auxiliary toilet stool seat main body portion 10 is not in use or when the auxiliary toilet stool seat main body portion 10 is washed with water, the auxiliary toilet stool seat main body portion 10 can be suspended on a wall or the like by the use of a hook 58 which is rotatably supported on the rear side of the auxiliary toilet stool seat main body portion 10 for air-drying.

Thus, as has been described heretofore, according to the invention, there can be provided the auxiliary toilet stool seat for infants which allows the auxiliary toilet stool seat to be fixed properly to the toilet stool seat or bowl and which can prevent the toilet stool seat or bowl from being given minute scratches when the auxiliary toilet stool seat is used thereon. While the invention has been described heretofore by reference to the preferred embodiment, the invention is not limited to the embodiment but can be modified variously without departing from a spirit and scope thereof.

What is claimed is:

1. An auxiliary toilet stool seat which can be mounted on a seat of a western-style toilet stool, the auxiliary toilet stool seat comprising:

a main body portion which is formed from a hard resin into an annular shape and arch shape in cross section which is made open at a bottom and is made flat at a top;

a circumferential edge packing made from a soft resin and adapted to cover a lower end of an outer circumferential edge of the auxiliary toilet stool seat;

a first leg portion which is brought into abutment with a top surface of the seat of the western-style toilet stool, a second leg portion is slidably and adjustably movable in such a manner as to follow an inner perimeter of the seat of the western-style toilet stool and to be brought into abutment with the inner perimeter of the western-style toilet stool; and and a third leg portion which is formed into an L-shape and is brought into press contact with a rear surface of the seat of the western style toilet stool on a horizontal surface of the L-shape, wherein the first, second and third legs being provided on a rear surface of the main body portion of the auxiliary toilet stool seat.

2. An auxiliary toilet stool seat as set forth in claim 1, wherein the first leg portion, the second leg portion, and the third leg portion each have a resin member for protecting the seat of the western-style toilet stool.

3. An auxiliary toilet stool seat as set forth in claim 1, wherein the third leg portion which is adjustably rotated around an axis passing through itself and adjustably extended or contracted in the longitudinal direction of itself so as to enable a proper press contact with the rear surface of the seat of the western-style toilet stool according to for accomodating a different thicknesses of the seat of the western-style toilet stool.

4. An auxiliary toilet stool seat as set forth in claim 1, wherein the auxiliary toilet stool seat comprises a rotatable hook by which the auxiliary toilet stool seat can be suspended.

5. An auxiliary toilet stool seat as set forth in claim 1, wherein an opening for a hot-water washing unit is provided on an inner edge of the auxiliary toilet stool seat.

6. An auxiliary toilet stool seat as set forth in claim 1, wherein the auxiliary toilet stool seat comprises a handle portion that is to be gripped by an infant when the infant uses the auxiliary toilet stool seat and has a handle portion mounting recess portion where the handle portion is mounted at a distal end portion of the auxiliary toilet stool seat, so that the handle portion is mounted and dismounted freely in either a forward direction or a backward direction.

7. An auxiliary toilet stool seat as set forth in claim 6, wherein the handle portion mounting recess portion is formed into an oval-like shape and comprises cut-out portions provided in positions on a circumferential edge thereof which diametrically face each other and an opening in a bottom side thereof, while the handle portion comprises a fitting portion adapted to be fitted in the opening on a lower side thereof and has engagement claw portions on a circumferential edge of the lower side thereof in such a manner as to appear and disappear for engagement with and disengagement from the cut-out portions, the engagement claw portions being made to appear and disappear in association with engagement and disengagement of the fitting portion in and from the opening.

* * * * *